United States Patent [19]

de Jong et al.

[11] Patent Number: 5,076,568

[45] Date of Patent: Dec. 31, 1991

[54] DAMPING SERVO-MOTOR CONTROL

[75] Inventors: Joannes N. M. de Jong, Suffern; Aron Sereny, Briarcliff, both of N.Y.

[73] Assignee: Xerox Corporation, Stamford, Conn.

[21] Appl. No.: 558,295

[22] Filed: Jul. 26, 1990

[51] Int. Cl.[5] ..... B65H 5/04

[52] U.S. Cl. ..... 271/275; 271/198; 198/502.4; 355/212; 346/134

[58] Field of Search ..... 198/504.2; 271/34, 35, 271/198, 275; 355/212; 346/134

[56] References Cited

U.S. PATENT DOCUMENTS

| | | | |
|---|---|---|---|
| 3,998,017 | 10/1976 | Kyhl . | |
| 4,318,540 | 3/1982 | Paananen et al. . | |
| 4,457,506 | 7/1984 | Ashbee et al. . | |
| 4,799,981 | 1/1989 | Stone et al. . | |
| 4,819,927 | 4/1989 | Noguchi et al. . | |
| 4,903,954 | 2/1990 | Robertson et al. | 346/134 X |

FOREIGN PATENT DOCUMENTS

| | | | |
|---|---|---|---|
| 0137691 | 9/1979 | German Democratic Rep. | 198/502.4 |
| 0148041 | 5/1981 | German Democratic Rep. | 198/502.4 |
| 0653185 | 3/1979 | U.S.S.R. | 198/502.4 |

*Primary Examiner*—H. Grant Skaggs
*Assistant Examiner*—Carol Lynn Druzbick
*Attorney, Agent, or Firm*—Oliff & Berridge

[57] ABSTRACT

A system for maintaining a uniform velocity of a belt which is driven on rollers. A first roller is provided with a first encoder which supplies a pulse train to a first control device which controls a first servomotor. The first servomotor drives the first roller which provides torque to the belt. A second roller is provided with a second encoder which supplies a pulse train to a second control device which controls a second servomotor for selectively dampening the second roller. When a variation in the speed of the belt is detected by the second control device a signal is sent from the second control device to the second servomotor. The second servomotor dampens any speed variations so that the belt maintains a constant speed at a location proximate to the second roller.

13 Claims, 3 Drawing Sheets

DAMPING SERVO-MOTOR CONTROL

CROSS REFERENCES

The present application is one of a series of copending applications containing related technical subject matter. The related applications are U.S. Ser. No. 07/560,813 filed July 31, 1990; and U.S. Ser. No. 07/627,207 filed Dec. 13, 1990; all of which are commonly assigned to the assignee of the present application.

BACKGROUND OF THE INVENTION

1. Field of the Invention

The present invention pertains to damping servo motor control mechanisms and more particularly pertains to a belt drive system (e.g. in photocopiers) having a main servomotor for driving a drive roller which drives a belt and a damping servomotor which dampens the velocity of an idler roller attached to the belt so that the velocity of the belt at a location near the idler roller is maintained constant. 2. Discussion of the Related Art The prior art is replete with examples of drive-belt mechanisms.

U.S. Pat. No. 4,799,981 to Stone et al. discloses a servo control mechanism to accurately wind and unwind a tape web from two spools to accurately apply strips or courses of tape carried by the web to a contoured surface. U.S. Pat. No. 4,457,506 to Ashbee discloses a servo-controlled recirculating automatic document feeder which transports a document along a simplex or duplex path. U.S. Pat. No. 4,318,540 discloses a constant spacing document feeder which provides constant spacing between documents of various length by means of a variable speed DC motor which drives a feed wheel.

U.S. Pat. No. 3,988,017 to Kyhl discloses a belt-driven work piece feeding device which uses a plurality of friction feeders to address the problem of feeding letters of various sizes through the device. U.S. Pat. No. 4,819,927 to Noguchi et al. discloses a flat article feeding apparatus which comprises a plurality of reversibly driven and individually urged pulleys. A first driving means drives an endless feed belt and an urging means urges the idler pulleys towards a feed plane so as to come in contact with a flat article. A second driving means drives the idler pulleys to make the pulleys reversedly feed the article. The pulleys are controllably driven in response to a completion signal.

In printers and photocopy devices, it is essential that printing belts be driven at a constant velocity. If printing occurs during a time when light intensity is constant and the velocity of the printing belt varies, light and dark bands will appear on the printed page (i.e. banding).

In color and high quality xerography the problems of banding are especially important to address. Tests have shown that any banding that shows up at a cycle per millimeter will be easily detected by the human eye (the eye being less sensitive to larger wave lengths and to shorter wave lengths).

Accordingly, a need is seen for a mechanism to control belt speed so as to achieve uniform printing quality.

SUMMARY OF THE INVENTION

Therefore it is an object of the present invention to provide a damping servomotor control having one or more damping servos to reduce velocity and torque disturbances in a belt which is driven by a main drive motor.

Yet another object of the present invention is to provide a damping servomotor control that reduces or eliminates banding on printed copies by providing a feed back mechanism which removes velocity and torque variations in a printer belt.

These and other objects and advantages of the present invention are achieved by a damping servomotor control having a first roller driven by a main drive motor. The first roller drives a belt and is provided with a first encoder which sends a pulse train to a first control device. The first control device evaluates the pulse train (e.g., by monitoring the pulse train frequency) and provides a signal through an amplifier to the main drive motor. If the first control device determines that a velocity variation is present in the first roller, the signal sent to the main drive motor will increase or decrease the speed of the motor thereby providing controlling torque to the belt. For example, if the frequency of the pulse train provided by the encoder diminishes, the control box determines that the velocity of the first roller has slowed down and more current is then provided to the drive motor to increase the velocity of the belt.

A second roller connected to the belt and located a distance from the first roller is provided with a second encoder which sends a pulse train to a second control device. The second control device is electrically connected through an amplifier to a servomotor. If the second control device detects a variation in the velocity of the second roller, a dampening signal is sent to the servomotor. The servomotor then increases or decreases the speed of the second roller as needed so that a constant velocity of the belt is maintained in the vicinity of the second roller.

BRIEF DESCRIPTION OF THE DRAWINGS

The invention will be described with reference to the following drawings in which like reference numerals denote like elements and wherein.

DETAILED DESCRIPTION OF THE PREFERRED EMBODIMENTS

High quality copiers and printers require excellent motion quality to produce high quality copies and prints. Detailed investigations have resulted in guidelines for required motion quality to avoid banding. These guidelines have been confirmed by experimental results. The severity of the motion quality requirement imposes stringent specifications on the motion control servo performance and, in many cases, these specifications cannot be met or can only be met at a great cost.

Figure 1:
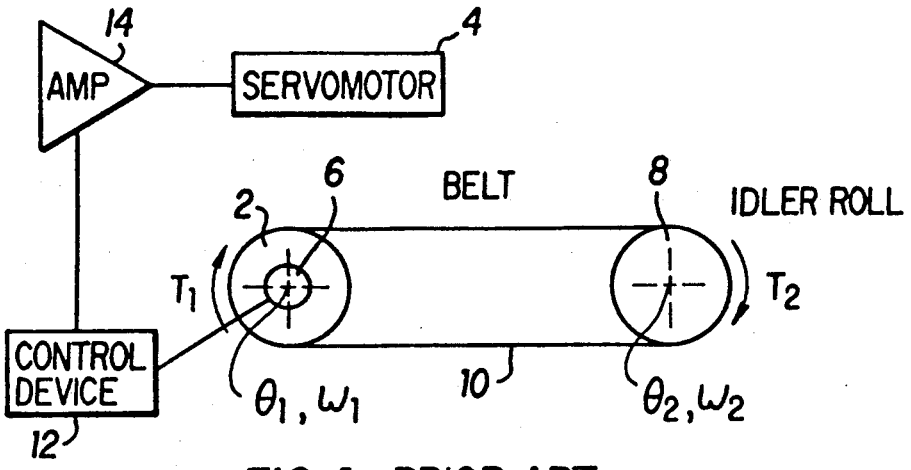
FIG. 1 PRIOR ART
FIG. 1 is a schematic illustration of a prior art belt module.

A typical example is the position/velocity of a belt module frequently used in copiers and printers (FIG. 1).

In its simplest form this belt module consists of a drive roller 2 with a main drive servomotor 4, and an encoder 6 connected to the shaft of drive roller 2. An idler roller 8 is located at an opposite end of belt 10. The servomotor 4 uses position ($\theta_1$) and velocity ($\omega_1$) feedback from the encoder 6 which is processed through control device 12 through amp 14 and on to servomotor 4 to generate a torque $T_1$. However, the belt 10 elastically connects the idler roller 8 to the drive roller 2 and thus the motion of this idler roller is not well controlled since velocity variations can occur at the idler roller 8 despite the controlled servomotor 4 of the drive roller 2.

Therefore, any of the copying or printing processes that take place at a location proximate to the idler roller are subject to inaccurately controlled motion. Also, in many cases the dynamics of the belt module produces resonances in the 10–100 Hz range, which at prevailing belt velocities results in spacial banding frequencies that are easily observed.

Figure 2:
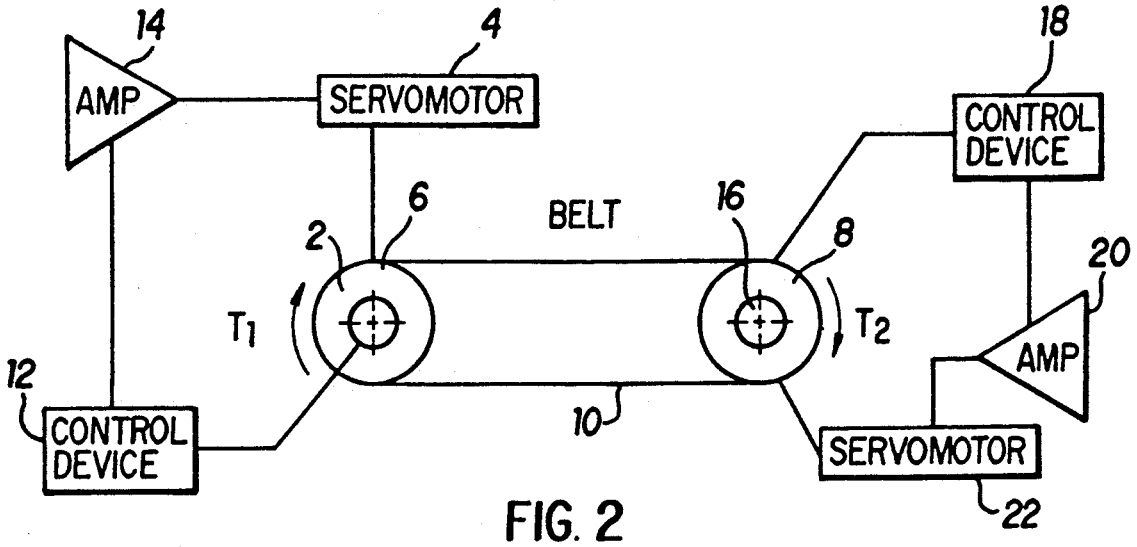
FIG. 2 is a schematic illustration of the dual servomotor system according to the present invention.

FIG. 2 illustrates a belt module which has the dual servomotor control system of the present invention. Drive roller 2 is connected to main drive servomotor 4 which receives a pulse train from encoder 6 located on the shaft of drive roller 2. After the pulse train has been interpreted by control device 12 a signal is output to amp 14 which amplifies the output signal to servomotor 4 so that the drive roller 2 is sped up or slowed down for purposes of generating controlling torque to the belt 10.

The belt module of FIG. 2 is further provided with a second encoder 16 located on the shaft of idler roller 8. The second encoder 16 is connected to a second control device 18 which interprets the pulse train from second encoder 16 and outputs a signal through amp 20 which results in more or less current being supplied to servomotor 22 for selectively dampening the idler roller 8 so that idler roller 8 maintains a constant velocity. Servomotor 22 acts only on velocity variations of the idler roller 8 and dampens vibrations as is shown in the analysis below.

A simplified mathematical model of the belt module dynamics of FIG. 2 is $$k(\theta_1-\theta_2)+\zeta S(\theta_1-\theta_2)-T_2=J_2S^2\theta_2 \quad (1a)$$

$$T_1-k(\theta_1-\theta_2)-\zeta S(\theta_1-\theta_2)=J_1S^2\theta_1 \quad (1b)$$

$$T_{12}-T_2=J_2S^2\theta_2 \quad (2a)$$

$$T_1-T_{12}=J_1S^2\theta_1 \quad (2b)$$

where

- k—torsional stiffness of belt (analogous to spring constant of a spring)
- $\zeta$—torsional damping
- $J_1,J_2$—moment of inertia of drive roller and idler roller
- $T_1,T_2$—applied controlling torques from servomotors 1 and 2
- $\theta_1,\theta_2$—angular position of shafts of drive roller 2 and idler roller 8
- S—Laplace operator
- $T_{12}$—interaction torque (i.e., torque from reactive forces on belt)

Equation 1a can be rewritten to yield $$\theta_2=\frac{(\zeta S+k)}{J_2S^2+\zeta S+k}\theta 1-\frac{1}{J_2S^2+\zeta S+k}T_2 \quad (3)$$

Figure 3:
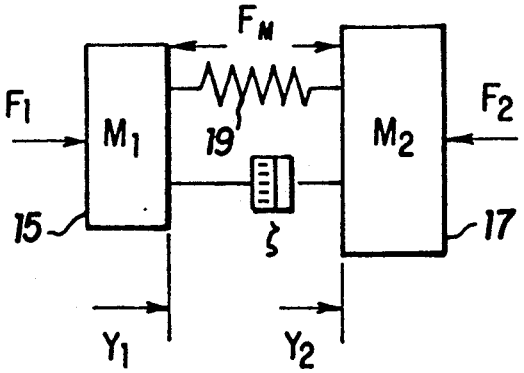
FIG. 3 illustrates a mass-spring-dash pot system.

For linear motion systems an equivalent mass-spring-dashpot system is shown in FIG. 3. Box 15 represents a mass $M_1$ (analogous to roller 2) which receives a force $F_1$ (analogous to the force produced by servomotor 4). Box 17 represents a mass $M_2$ (analogous to roller 8) which receives a force $F_2$ (analogous to the force produced by servomotor 22. Spring 19 is analogous to belt 10 and linear position $Y_1$ and linear position $Y_2$ are analogous to angular positions $\theta_1$ and $\theta_2$. Reactive force Fm of spring 19 is analogous to the force which produces interaction torque $T_{12}$.

Figure 4:
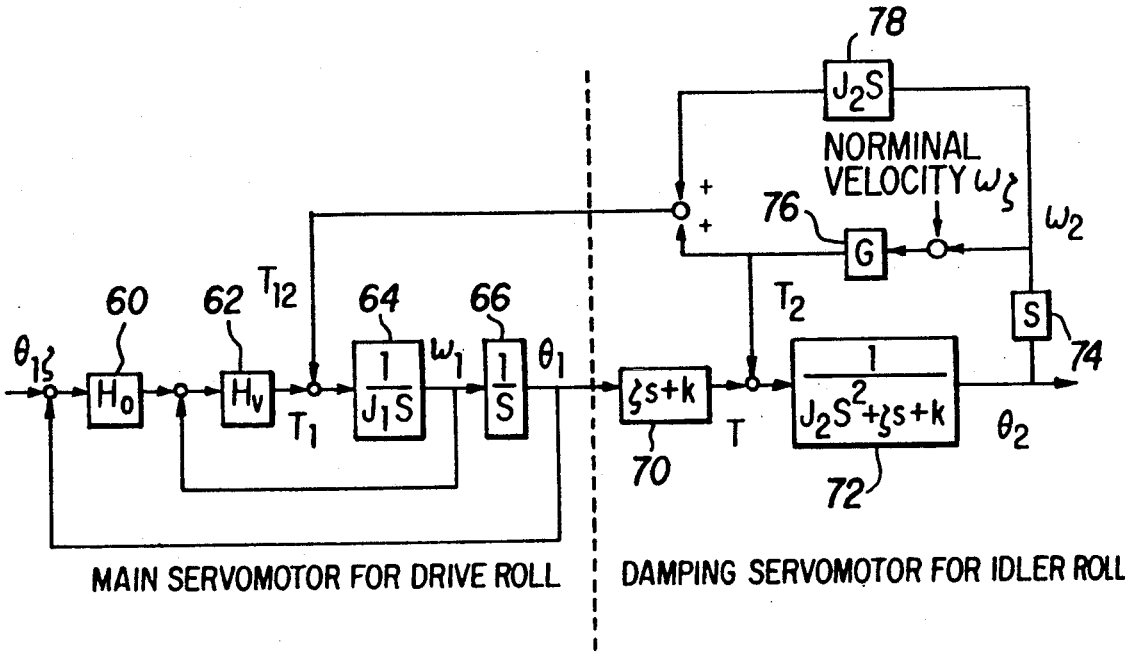
FIG. 4 is a flow-chart illustrating the closed-loop feedback of the present invention.

A block diagram which makes use of equations 1, 2 and 3 is shown in FIG. 4. The left side of FIG. 4 shows the control loop for servomotor 4 and the right side of FIG. 4 shows the control loop for servomotor 22. Control device 12 implements the velocity and position control operations mathematically represented by boxes 60, 62. Boxes 64, 66, 70, 72, 74 and 78 represent equations 1a and 1b. Control device 18 implements the damping control operation represented by box 76. The left side of the block diagram is a conventional drive roller servomotor control loop in which the interaction torque $T_{12}$ acts as a disturbance.

Equation 1a provides a mathematical analysis of the summation of torques on roller 8 and equation Ib provides an analysis of the summation of torques on roller 2 (FIG. 2). Equations 1a and 1b are further simplified in equations 2a and 2b above. Proper tuning of this loop eliminates most of this disturbance. The right side of this block diagram is from equations 2 and 3, but also includes a velocity control loop with setpoint $\omega s$ and controller gain G. The term $\omega_s$ is the velocity setpoint for the damping servo loop. It should be set to the average velocity generated by the main drive motor. The function of this control loop is to reduce velocity variations of the idler roller. The effect of this loop is similar to providing damping of magnitude G that is added to the natural damping. This is shown by computing the closed loop transfer function between $\omega_2$ (s) and $\omega_{1s}$ as follows:

$$\frac{\omega_2(s)}{\omega_{1s}(s)}=\frac{GS}{J_2S^2+(G+\zeta)+K} \quad (4a)$$

and similarly, $$\frac{\omega_2(s)}{T^*(s)}=\frac{S}{J_2S^2+(G+\zeta)S+k} \quad (4b)$$

According to equation 4 the gain G could be very large and thus provide large damping. However, in practice the gain margin requirement of very high torsional resonances (1–4 kHz) limits the magnitude of the gain G.

The main and damping servomotor control system of the present invention was tested on a photocopy research machine. This machine is a 300 spi, 4 color, continuous tone copier or printer using liquid ink development. A reciprocating or shoe shine technique is used to move the paper back and forth to print the 4 colors. In addition the paper may be moved in the forward direction only.

Figure 5:
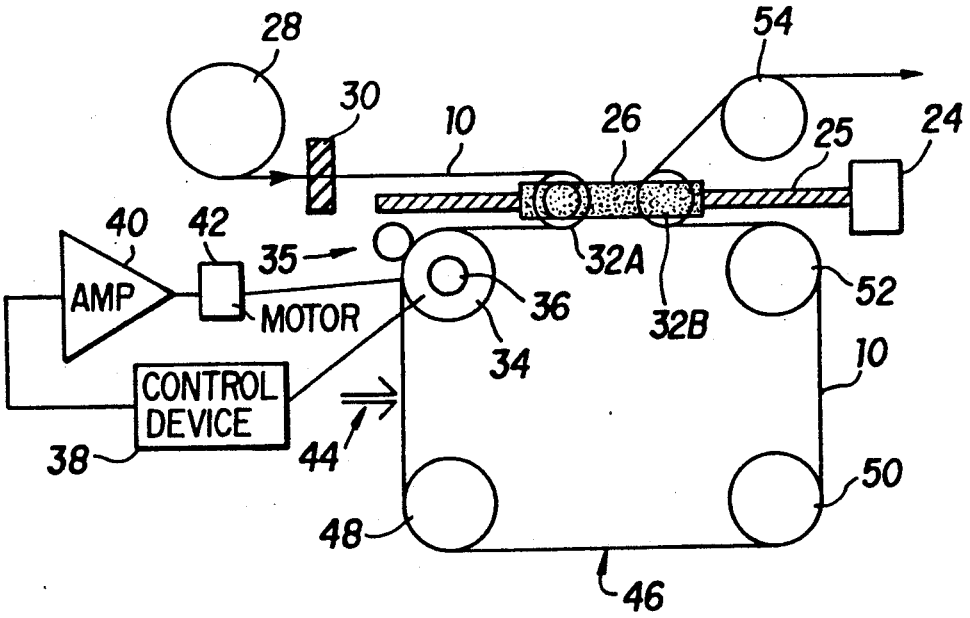
FIG. 5 is a schematic illustration of the photocopy machine which was used to test the results of the present invention.

With reference to FIG. 5, the research machine has a paper roll 28 and paper clamp 30 which clamps paper (not shown) onto belt 10 which extends through the machine. Lead screw motor 24 is the main drive motor of the machine and is provided with an encoder (not shown). The encoder provides a pulse train to a first control device (not shown) which supplies a feedback signal to lead screw motor 24 so that the position of lead screw 25 and the paper are properly controlled. Carriage 26 equipped with idler rollers 32A and 32B moves back and forth on lead screw 25. As carriage 26 moves to the left, the paper will proceed to move down past writing head 44. Forward idler roller 34, in frictional contact with pinch roll 35, is provided with an encoder 36 which sends a pulse train to a second control device 38 which connects through AMP 40 which connects to servomotor 42 which selectively dampens the velocity of the forward roller 34. Writing head section 44 is located just down stream of forward idler roller 34 with development zone 46 being located between idler rollers 48 and 50 and idler roller 32B being located between idler roller 52 and tensioner 54.

If servomotor 42 is not utilized, when the writing function takes place, the moment of inertias of the rollers and the elasticity of the belt and paper induce very low damped resonances which cause banding in the developed print. However, by implementing the previously described method (i.e. using a second servomotor 42 to dampen the speed of forward idler roller 34) this banding can be eliminated.

The velocity signal from encoder 36 can be obtained by measuring the time interval between encoder lines. The time interval is inversely proportional to velocity, but since velocity variations are small any nonlinearity can be neglected. Control device 38 has a time interval measurement circuit which consists of a preset counter with clock frequency $F_c$ which latches upon the arrival of an encoder pulse. An eight bit digital to analog converter in control device 38 converts the latched count to an analog output for use as a velocity signal. The preset allows adjustment to make the average value of the analog output equal to zero. This way only velocity variations produce a torque output.

Figure 6:
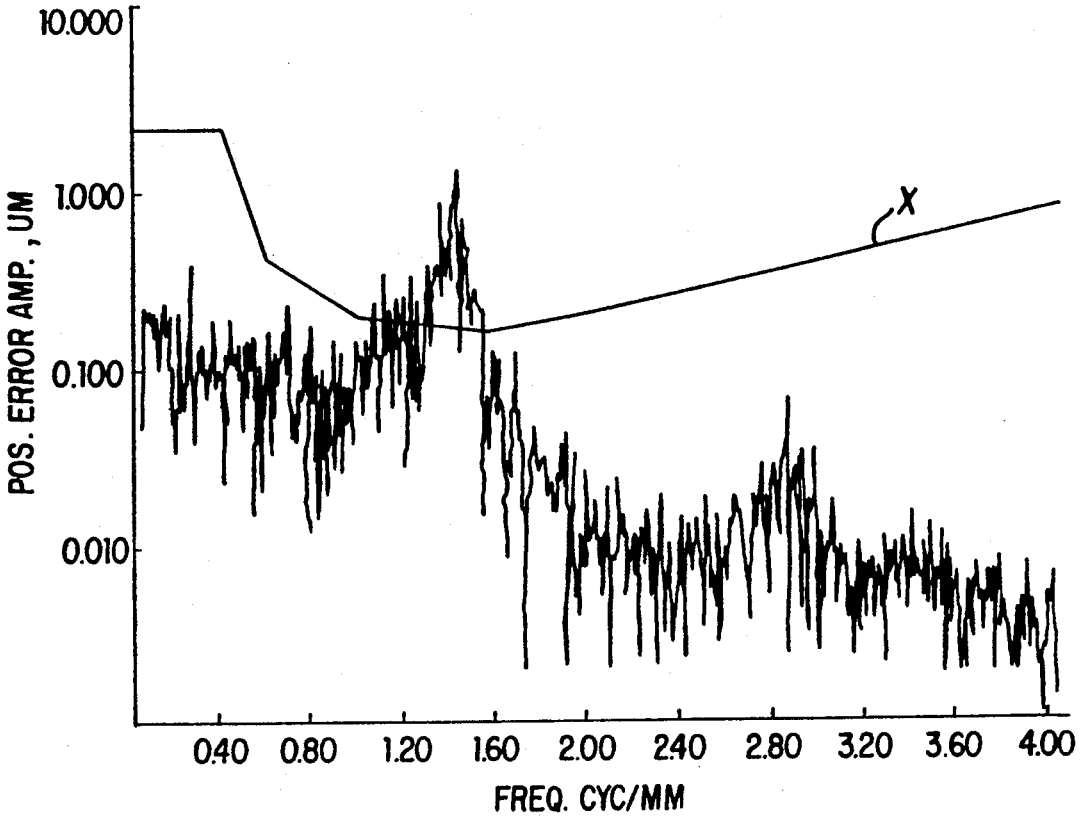
FIG. 6 is a graph showing the high level of position error when the test machine did not utilize the teachings of the present invention.
Figure 7:
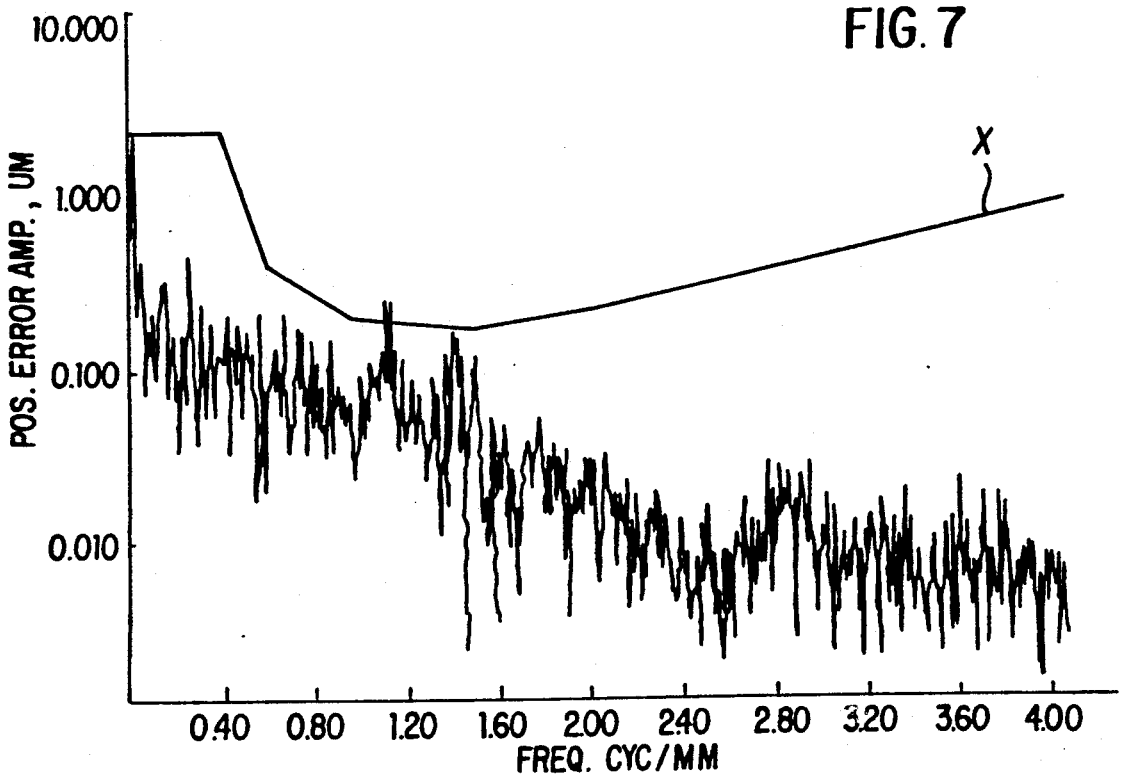
FIG. 7 is a graph showing the greatly reduced position error of the test machine when the teachings of the present invention were utilized.

The results of tests of the research machine are shown in FIGS. 6 and 7. These graphs show the position error amplitude in micrometers for each frequency cycle per millimeter. FIG. 6 shows the motion quality as measured by encoder 36 without servomotor 42 being activated. The large peak at 1.3 cycles/mm does not satisfy Hamerly's criterion as represented by curve X and leads to banding. This was clearly visible in the actual print. FIG. 7 shows the motion quality with servomotor 42 being activated and the resulting improvement is substantial. In this case there was no banding in the printed image.

The above scheme for the application of a damping servo control system can be extended to a variety of different configurations. In these applications it is important to notice that in many cases the main drive servo can be replaced by an inexpensive constant velocity AC motor with or without a gear box. Such a motor typically can provide a large torque at a constant velocity without feedback controls. However, the influence of torque/velocity disturbances cannot be reduced by this main drive. The use of a damping servo that is in parallel or series with this main drive can very effectively improve the motion quality as was shown above.

The teachings of the invention can be applied to systems having multiple rollers (e.g. driver rollers, idle rollers and damping servo rollers) in a variety of combinations.

The foregoing description of the preferred embodiments is intended to be illustrative and not limiting. Numerous additional modifications and variations of the present invention are possible in light of the above teachings. It is therefore to be understood that the invention may be practiced otherwise than as specifically described herein and still within the scope of the appended claims.

What is claimed is:

1. A system for controlling velocity variations in a belt wrapped about at least a first driven roller and a second idler roller spaced apart from the first driven roller, comprising:

means for driving said first roller so as to provide torque to the belt; and dampening means connected to said second roller for minimizing variations of the velocity of the belt at a location proximate to said second roller by selectively dampening the second roller.

2. A system according to claim 1, wherein the dampening means includes:

means for sensing the velocity of the second roller; and control means responsive to the sensed velocity for controlling the velocity of the second roller so as to maintain constant belt velocity at the location proximate to the second roller.

3. A system according to claim 2, wherein the sensing means is an encoder provided on a shaft of said second roller.

4. A system according to claim 2, wherein the control means includes a servomotor connected to a shaft of said second roller.

5. A system according to claim 1, wherein:

the drive means for the first roller includes an encoder connected to a shaft of said first roller.

6. A system according to claim 5, further comprising:

control means responsive to the encoder of said first roller for driving the first roller at a constant velocity.

7. A system according to claim 1, wherein:

the belt is located in a photocopy machine wherein a belt transported media paper receives an image; and the second idler roller is adjacent a writing head section of the photocopy machine.

8. A method for maintaining a constant velocity of a belt wrapped about a main drive roller and an idler roller at a location proximate to the idler roller, said belt being driven by a main drive motor connected to the main drive roller, said main drive roller and said idler roller being separated by a distance, said method comprising the steps of:

a) monitoring the velocity of said idler roller;

b) determining if any variation of speed is occurring at said idler roller;, and c) selectively driving and dampening the speed of said idler roller so that the speed of said belt proximate to said idler roller is maintained constant.

9. A method according to claim 8, wherein said dampening decreases the speed of said idler roller.

10. A method according to claim 8, wherein said driving increases the speed of said idler roller.

11. A method according to claim 8, wherein said idler roller is connected to a servomotor which provides said driving and dampening.

12. A method according to claim 8, wherein said idler roller is proximate to the writing head of a printer.

13. A method according to claim 8, wherein the step of monitoring the velocity of the idler roller includes monitoring the frequency of a pulse train generated by an encoder.

* * * * *